United States Patent [19]

Oger et al.

[11] Patent Number: 4,499,695

[45] Date of Patent: Feb. 19, 1985

[54] MANHOLE

[75] Inventors: Jacques Oger, Pont-à-Mousson; Jean-Claude Hauer, Saulxures lès Nancy; Jean-Louis Freis, Saint Nicolas de Port, all of France

[73] Assignee: Pont-A-Mousson S.A., Nancy, France

[21] Appl. No.: 357,122

[22] Filed: Mar. 11, 1982

[30] Foreign Application Priority Data

Mar. 18, 1981 [FR] France ..... 81 05400

[51] Int. Cl.[3] ..... E02D 29/14

[52] U.S. Cl. ..... 52/19; 404/25

[58] Field of Search ..... 52/19, 20, 21; 404/25, 404/26, 2; 210/163

[56] References Cited

U.S. PATENT DOCUMENTS

| | | | |
|---|---|---|---|
| 4,015,373 | 4/1977 | Boissier | 52/20 |

FOREIGN PATENT DOCUMENTS

| | | | |
|---|---|---|---|
| 2484498 | 12/1981 | France | 52/20 |
| 391917 | 5/1933 | United Kingdom | 404/25 |
| 442794 | 2/1936 | United Kingdom | 404/25 |
| 482517 | 3/1938 | United Kingdom | 404/25 |
| 492190 | 9/1938 | United Kingdom | 52/20 |

*Primary Examiner*—Carl D. Friedman

*Attorney, Agent, or Firm*—Sughrue, Mion, Zinn, Macpeak & Seas

[57] ABSTRACT

A manhole cover plug (1A) contains three helical ribs (5A) whose profile, in transverse cross-section, has two lateral quarter-circular parts (11A, 12A). These lateral parts cooperate with helical grooves of the frame with a quarter-circular profile of a greater radius.

6 Claims, 6 Drawing Figures

FIG. 4
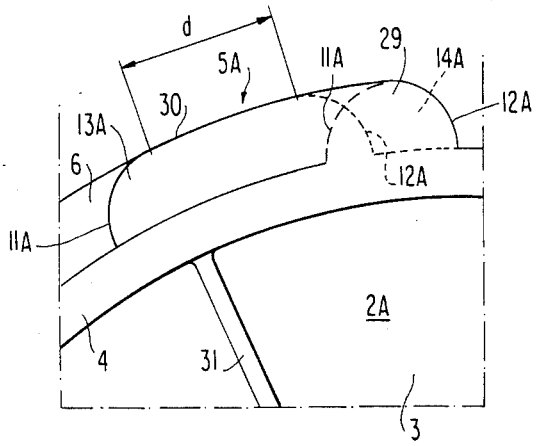
FIG. 5
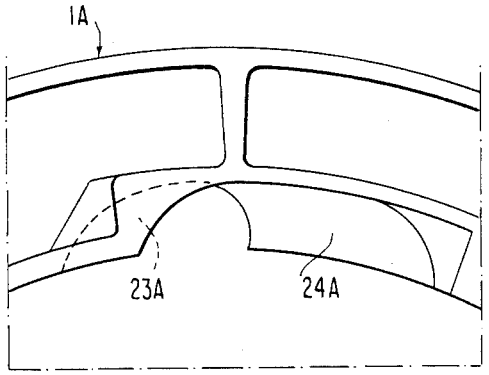
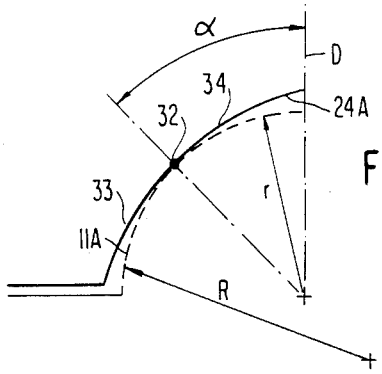
FIG. 6

MANHOLE

The present invention relates to a manhole cover assembly of the type comprising a frame intended to be sealed in the highway covering and a removable cover or plug cooperating with this frame.

A manhole cover assembly whose frame is incorporated in the road covering has a plug which is subjected to vehicular stresses, such as acceleration, braking or, more simply, the suction effect of the tire on the cover when the vehicle moves at a constant speed. It is therefore indispensable, for obvious safety reasons, for the plug not to be able to rise inside its frame, or even to be removed from frame. For this reason, there is generally a locking device which can only be activated by skilled personnel for this purpose, outside of any fortuitous mechanical intervention.

The locked plug must also respect another imperative, which is not to rock inside its housing, since any oscillation around an axis of rotation passing by two of the support points of the plug generates a knocking noise between the components of the manhole, said noise being particularly unpleasant for those nearby.

The object of the invention is to provide a manhole cover assembly with means for locking the plug which are both very efficient and simple to produce and use and which eliminate any risk of rocking of the plug.

For this purpose, the object of the invention is a manhole of the above-identified type, in which the two elements comprise respectively on their periphery three helical ribs in the form of screw threads and three grooves conjugated with at least one part of said ribs.

These ribs ensure self-locking of the plug if each rib has, in transverse cross-section, an area which is variable in length to thus ensure a wedge effect with the related rib. In addition, an auto-compensation of the radial plays between the plug and the frame is obtained when each horizontal cross-section of the ribs has a non-radial upper side and/or lower side turned radially towards the exterior in accordance with judiciously selected angles.

In order to render possible molding without a nucleus of the component provided with grooves, each groove preferably comprises a lower ramp and an upper ramp offset one in relation to the other in the circumferential sense and belonging to two interior projections of the frame in the form of points.

In accordance with another aspect of the invention, each transverse cross-section of the ribs has two rounded lateral parts and the corresponding cross-sections of the grooves have, in their parts intended to cooperate with said lateral parts, a concave shape with a greater radius of curvature than that of said lateral parts.

Preferably, said parts of the grooves and ribs have a quarter-circular shape, with a larger radius for the grooves.

Other characteristics and advantages of the invention will become apparent from the following description which is given as a non-limitative example and in relation to the attached drawings, wherein:

FIG. 4 is a schematic view from below of a part of the periphery of the plug of a manhole cover assembly according to one alternative embodiment of the invention;

FIG. 5 is a schematic view from above of a part of the periphery of the frame of said manhole cover assembly;

FIG. 6 is a diagram illustrating the contact between a rib and its groove.

Figure 1:
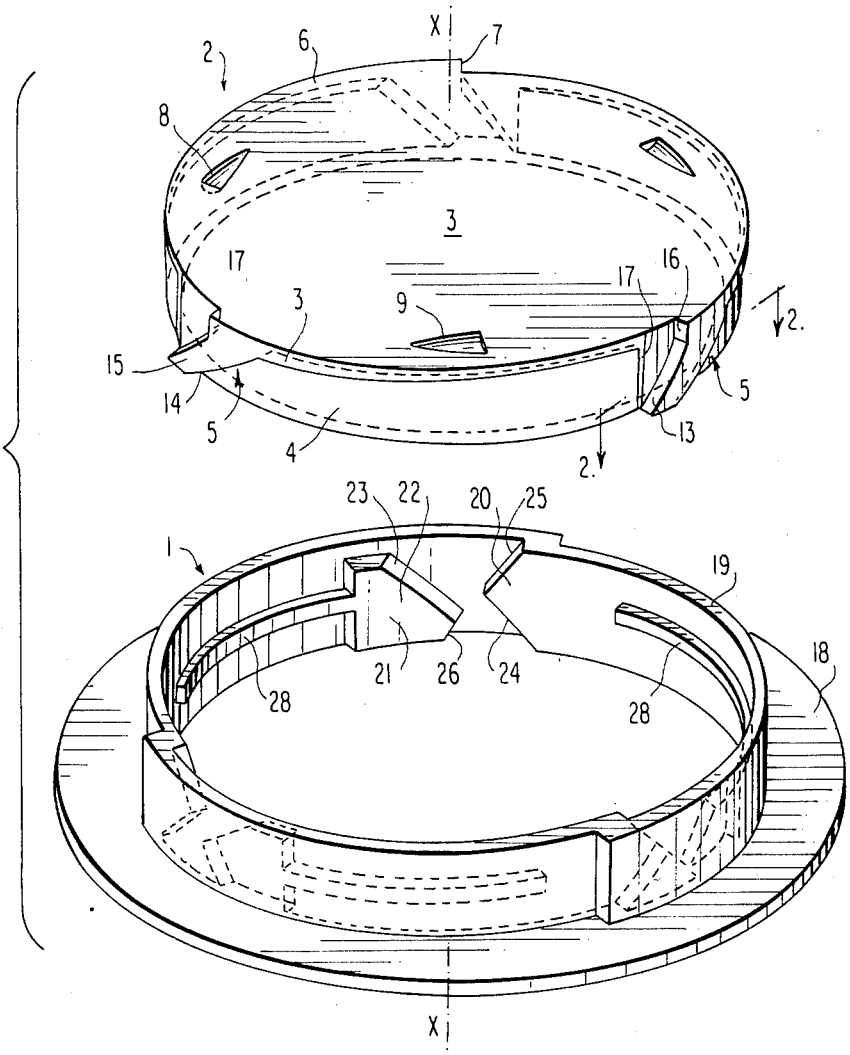
FIG. 1 is a schematic perspective view of a manhole cover assemnbly in accordance with the invention.
Figure 2:
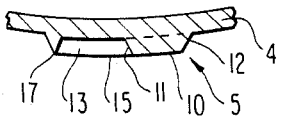
FIG. 2 is a detailed view of the plug taken in horizontal cross-section along line 2—2 of FIG. 1.
Figure 3:
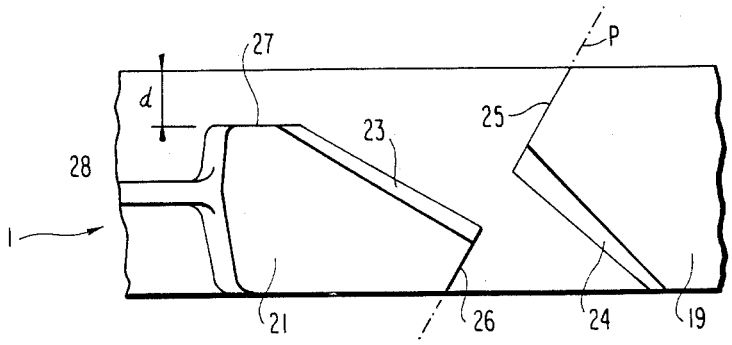
FIG. 3 is an elevational view of a detail of the frame.

The manhole cover assembly shown in FIGS. 1 to 3 is composed of two rough-cast ductile cast iron components, which are a frame 1 intended to be sealed in a highway covering and a removable cover or plug 2. Each of components 1 and 2 has ternary symmetry around a common vertical axis X—X, i.e., each of their points is found by a rotation of 120° around the axis X—X.

The plug 2 is composed of an upper cover 3 and a skirt 4 provided with three exterior reliefs 5.

The cover 3 is planar, relatively thin and approximately circular in shape. However, it has three excrescences 6 with a progressively increasing radius beyond this circular shape; each excrescence 6 ends with an approximately radial side 7 which connects it to the root of the following excrescence 6.

The upper surface of cover 3 contains near its periphery three circumferentially oriented impressions 8. Each impression 8 is triangular in shape and has a depth increasing from the point of the triangle up to a vertical and radial surface 9 situated approximately halfway, in the circumferential sense, between the two adjacent sides 7. The upper surface of the cover 3 also comprises non-skid reliefs (not shown).

The skirt 4 extends towards the bottom of the lower surface of the cover 3. It is cylindrical and externally tangental to the circle beyond which the excrescences 6 project.

Each relief 5 has the general shape of a rib constituting approximately a portion of a screw thread. More specifically, it has a total orientation which is approximately helical and has a transverse cross-section (FIG. 2) in the shape of an isosceles trapezoid whose area decreases progressively towards the bottom in a generally homothetic manner. This section comprises a large base blended with the exterior wall of skirt 4, a small base 10, an oblique upper side 11 and an oblique lower side 12. Thus, relief 5 comprises a non-radial upper surface 13 and a non-radial lower surface 14, both turned radially outwards, and an approximately cylindrical peripheral surface 15.

Surface 13 ends a little beneath the lower surface of cover 3 and is extended upwards by a small vertical and radial surface 16 which is approximately rectangular and whose upper side is composed of side 7 of an excrescence 6. Surface 14 extends upwards up to the lower surface of said excrescence 6, and surface 15 blends at its upper end with the external surface of said excrescence. Surfaces 13 and 14 are left and helical like those of a screw thread.

The reliefs 5 extend downward to the lower surface of the planar skirt. Between the base of surface 13 and the beginning of the excrescence 6 which overhangs it, skirt 14 has an increased thickness 17 with vertical generatrices which follow the exterior contour of said excrescence. This enables molding without a nucleus of the assembly of the plug 2, including the reinforcing ribs (not shown) located inside the skirt 4.

Of course, the surfaces described as vertical in the preceding description are in reality slightly inclined in accordance with a tapered angle enabling easy unmolding.

Frame 1 comprises a lower planar support sole 18, with an annular shape, from the interior periphery from which a cylindrical stem 19 extends upwardly. This stem has the same planar shape as cover 3 of the plug, that is circular with three excrescences, its interior radius at each point being slightly greater to the exterior radius of a corresponding point of cover 3.

Stem 19 has a uniform thickness over its entire circumference, except at the root of each excrescence of the frame, where said stem extends internally into a point 20 in increased thickness in the cavity defined by the following excrescence. In addition, a block 21 projects into said cavity defining a second point 22 located approximately opposite point 20 but offset in the circumferential sense and downwardly in relation to said point 20.

More specifically (FIG. 3), from the side of point 20, block 21 has an upper surface 23 forming a ramp conjugated with the upper part of a surface 14, whereas the lower surface 24 of point 20 forms a ramp conjugated with the lower part of a surface 13. The two other surfaces 25, 26 of the two points 20 and 22 have a same diametrical plane P inclined on the horizontal. Block 21 also comprises an upper planar and horizontal surface 27 situated at a distance d from the upper edge of the stem 19 which is greater than the total thickness of the cover 3 with its non-skid reliefs.

Finally, halfway up stem 19 there is an interior horizontal rib 28 going from the end of each opposite block 21 to its point 22.

Due to the general conformation of frame 1 and in particular of points 20 and 22, the frame is moldable without a nucleus like plug 2, so that the manhole cover assembly 1-2 is very economical to produce on an industrial scale.

In service, the frame 1 is sealed in the highway covering and is flush with the highway surface. In order to place plug 2, the base of surfaces 14 is placed on the ramps 23. A slight impulse in the screwing sense is then sufficient to helically lower the plug along the axis X—X under the effect of its own weight.

During this movement, the surfaces 14 slide on the ramps 23 and reliefs 5 penetrate under points 20, until surfaces 13 come into contact with surfaces 24. There is then a double contact 14–23 and 13–24, theoretically over the entire surface of surfaces 23 and 24. The slope of surfaces 24 causes a descending centripetal reaction on surfaces 13, and the result is an effect of auto-centering of the plug even if the starting position of said plug is imperfect.

When the plug has completed its descending movement, it is perfectly locked and cannot either raise up or rock, due to the conformation of reliefs 5. Ribs 23 prevent foreign bodies from entering into the inspection shaft as well as the fall of plug 2 when said plug is placed in an incorrect angular position.

To remove the plug, a blow with a pickax is given against surface 9 of an impression 8 in cover 3, which ensures unlocking. Then the plug is raised by an unscrewing movement either by action on a part overhanging cover 3, around a relief 5, or by pressing the pick against surface 16 of a relief and against surface 25 of the opposite surface 25 of the frame. As an alternative, for the raising of the plug, two diametrically opposite holes may be provided in cover 3 enabling the hooking up of a raising instrument such as a winch.

The automatic absorption of the radial plays between the plug and the frame during the placing of the plug necessitates that, in the horizontal cross-section of each rib 5 (FIG. 2), the sides 11 and 12, respectively with the radial direction, make angles at least equal to 28° and at most equal to 45°. In effect, these angular values ensure in at least one horizontal cross-section of the manhole six effective regions of contact 13–24 and 14–23.

Consequently, when the trapezoid (or, in the alternative, the triangle) formed by the horizontal cross-section of the ribs is isosceles, its angle at the top should be between 56° and 90°.

The slope of the ramps 23 should be greater than the coefficient of friction of cast iron on cast iron so as to provide the lowering of the plug under the effect of its own weight. Since this coefficient is 0.3, the slope selected will be at least equal to 18°, and preferably greater than this value to take into account the possible presence of foreign bodies.

The helical shape of surfaces 13 and 14 (or 23 and 24) ensures coincidence of surfaces 13 and 14 of the plug with the corresponding surfaces 24 and 23, respectively, of the frame whatever the depth of the plug, which varies in accordance with manufacturing tolerances, which is particularly advantageous for rough-cast components. This contact between indentical surfaces produced in a sure manner considerably limits the risk of matting of the metallic components which, when it occurs, can impede the extraction of the plug from its frame.

According to the alternative embodiment shown in FIGS. 4 to 6, where the references designating the components previously described bear the suffix "A" when said components have been modified, the shape of the horizontal cross-section of the ribs 5A of plug 2A and the ramps 23A and 24A of frame 1A have been modified.

In effect, as is seen in FIG. 4, the lower cross-section 29 of the ribs 5A has the shape of a convex semi-circle centered on the outside surface of the skirt 4 of the plug. The two quarter circles 11A, 12A comprising this semi-circle separate progressively going upward along rib 5A, without changing radius and remaining centered on the external surface of skirt 4, up to a maximum separation d at the level of the lower surface of cover 3. The upper side of the ribs extends to the level of the upper surface of said cover. In each cross-section situated above the lower cross-section 29, the two quarter circles are connected by a rounded piece 30 whose shape corresponds to that of the part of the excrescence 6 which overhangs this section. A radial rib 31 for rigidification of the plug can also be seen in FIG. 4.

Likewise, ramps 23A and 24A each have, in horizontal cross-section, the shape of a concave quarter circle with a radius R greater than the radius r of the quarter circles of ribs 5A, the center offset towards the interior of the manhole cover assembly. In each ramp, the line of the centers of the quarter circles is parallel to that of the associated part of the corresponding rib 5A.

The plug places itself in the frame in the same manner as above. In each section, the three contacts 13A–24A or 14A–23A take place at contact points 32 of the associated quarter circles (FIG. 6). The angle $\alpha$ formed by the normal with two quarter circles in contact at point 32 and the radial direction D of the plug passing by the center of the quarter circle 11A or 12A in question is at the maximum equal to 60° and preferably, as shown, equal to 45°. When this angle diminishes, the stresses exerted on the plug become very great and necessitate corresponding reinforcement.

The plug is thus in contact with the frame along six helical curved lines, and experience shows that these lines are relatively well defined and only move slightly, for example along arc 33–34 of FIG. 6 centered on point 32, during recentering of the plug which takes place in use under the effect of rolling loads.

As an alternative, the shape of the lateral parts of the ribs 5A could be in horizontal cross-section a curve differing from a quarter circle, and the radius of curve of the cross-sections of ramps 23A and 24A could be increased to infinity, in which case these cross-sections would be straight-line segments as described previously.

We claim:

1. A manhole cover assembly of the type comprising a frame intended to be sealed in a highway covering and a removable cover or plug engaging said frame, said plug comprising on its periphery facing said frame three helical ribs in the shape of screw threads and said frame comprising on its periphery facing said plug three helical grooves, said grooves receiving said ribs, and wherein each rib (5A) in transverse cross-section is comprised of two lateral rounded parts (11A, 12A) and wherein the corresponding grooves in cross-section have corresponding parts (23A, 24A) for engagement with said lateral rounded rib parts (11A, 12A), of concave shape with a radius of curvature (R) greater than the radius of curvature (r) of said rib lateral parts (11A, 12A), and wherein the area of the transverse cross-section of the ribs (5A) decreases from top to bottom.

2. The manhole cover assembly of claim 1, wherein the lateral parts (11A, 12A), of the ribs (5A), in cross-section, have the shape of a quarter circle.

3. The manhole cover assembly of claim 2, wherein said parts (23A, 24A) of the grooves have the shape in cross-section of a quarter circle with a radius (R) greater than that (r) of the lateral parts (11A, 12A) or ribs (5A).

4. The manhole cover assembly of claim 1, wherein the lateral parts (11A, 12A) of the ribs (5A) all have the same profile in cross-section.

5. The manhole cover assembly of claim 1, wherein, in each cross-section, the angle ($\alpha$) formed by the normal with each rib (5A) at its point of contact (32) with its groove and the radial direction (D) of the plug (1A) does not exceed 60°.

6. The manhole cover assembly of claim 5, wherein said angle ($\alpha$) is on the order of 45°.

* * * * *